United States Patent [19]

Sluys

[11] 4,252,470

[45] Feb. 24, 1981

[54] UTILITY DISTRIBUTION SYSTEM FOR FLOATING PIERS

[75] Inventor: Wesley W. Sluys, Bellingham, Wash.

[73] Assignee: Builders Concrete, Inc., Bellingham, Wash.

[21] Appl. No.: 57,595

[22] Filed: Jul. 16, 1979

[51] Int. Cl.[3] ..... B63B 35/44

[52] U.S. Cl. ..... 405/219; 52/221; 114/263; 405/218

[58] Field of Search ..... 405/219, 220, 221, 218; 114/236, 267, 266; 52/220, 221

[56] References Cited

U.S. PATENT DOCUMENTS

| | | | |
|---|---|---|---|
| 3,074,238 | 1/1963 | De Golian | 405/219 |
| 3,283,517 | 11/1966 | Phillips | 405/219 |
| 3,537,219 | 11/1970 | Navarre | 52/221 X |
| 3,552,424 | 1/1971 | Thompson | 114/263 X |
| 3,818,659 | 6/1974 | Anderson | 52/220 |
| 3,965,629 | 6/1976 | Pearson | 52/220 X |
| 4,070,980 | 1/1978 | Shorter | 114/263 |
| 4,085,696 | 4/1978 | Shorter | 114/267 X |

FOREIGN PATENT DOCUMENTS

| | | | |
|---|---|---|---|
| 1523840 | 3/1968 | France | 114/263 |

*Primary Examiner*—Dennis L. Taylor

*Attorney, Agent, or Firm*—Seed, Berry, Vernon & Baynham

[57] ABSTRACT

A system for distributing utility service such as electrical power, telephone service and water to a plurality of spaced apart finger floats extending angularly from a floating mainwalk. The floats are formed by rectangular concrete shells filled with a buoyant material and having a plurality of tie rods extending transversely through the floats with their ends projecting from the sides. The floats are typically fastened to each other by elongated wales extending along the sides of the floats which bridge the joints between adjacent floats. In one embodiment the wales include inner and outer wale members separated from each other by a plurality of rectangularly shaped spacers. The spacers as well as the gap between the wale members are preferably covered by an elongated cover. Utility conduits extend along the gap between the inner and outer wale members and are supported by the spacers. Utility outlet fixtures are mounted on the wale members thereby allowing the utility conduits to be easily connected to the utility outlet since the utility conduits are positioned directly beneath the fixtures. In another embodiment the spacers form a continuous beam extending along the side of each mainwalk float. The utility conduits extend through the beam to a plurality of conventional utility outlets mounted directly on the beams.

14 Claims, 14 Drawing Figures

FIG. 1
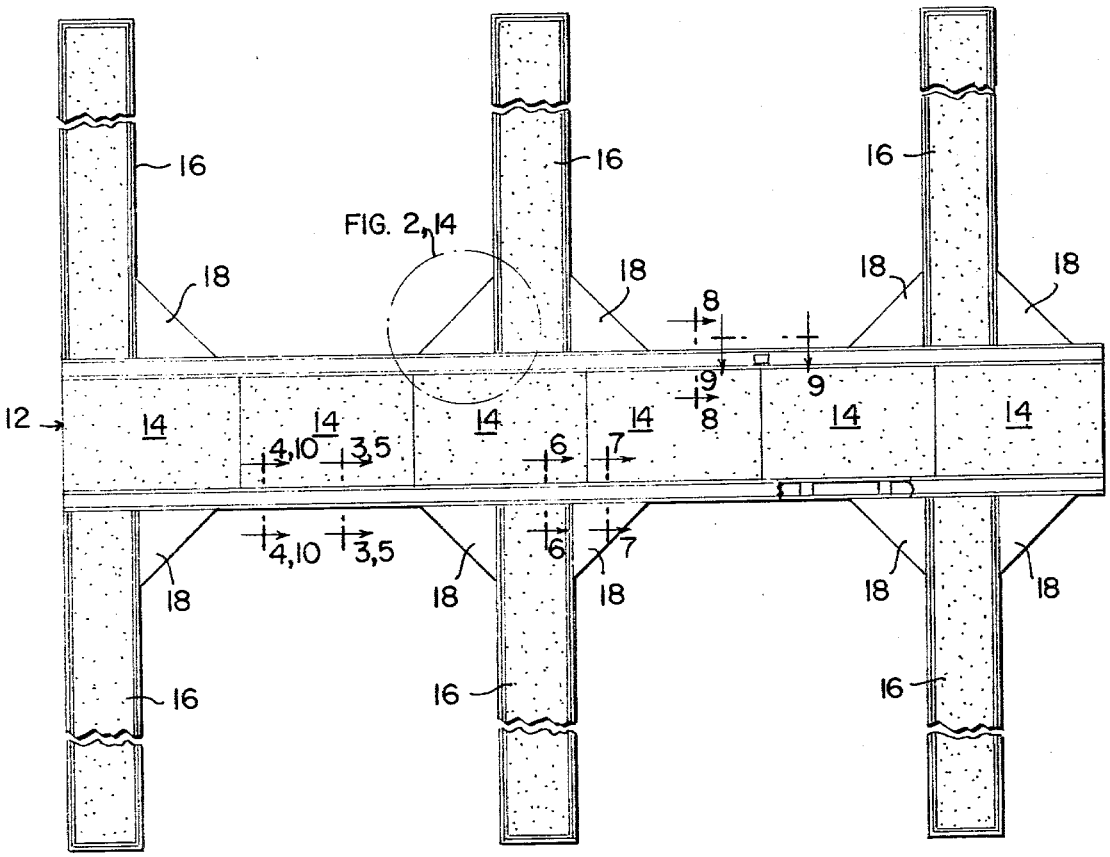
FIG. 2
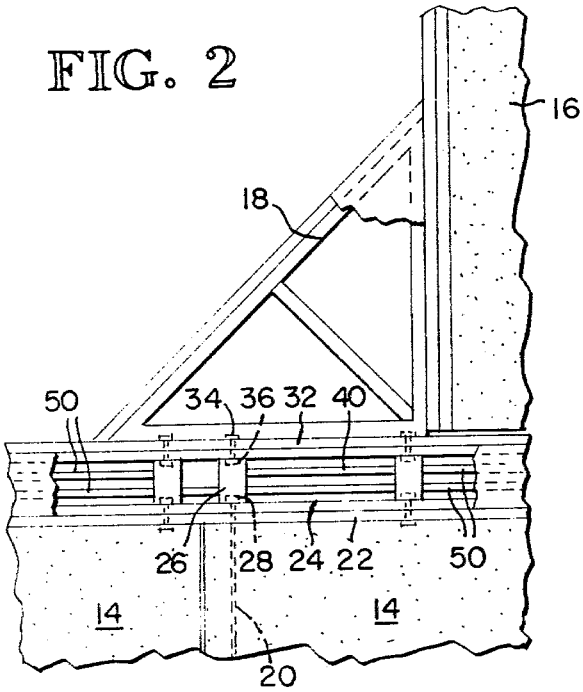
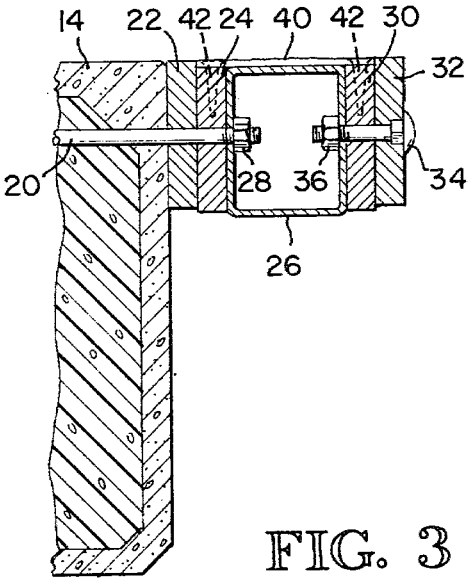
FIG. 3

FIG. 12
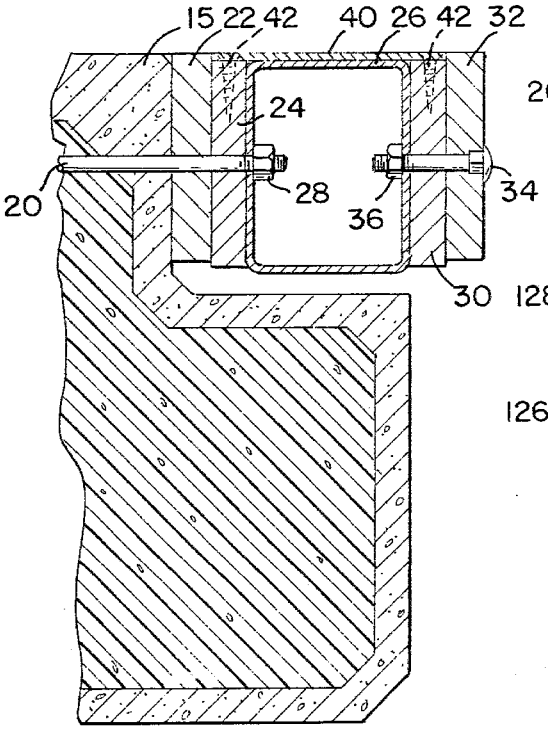
FIG. 13
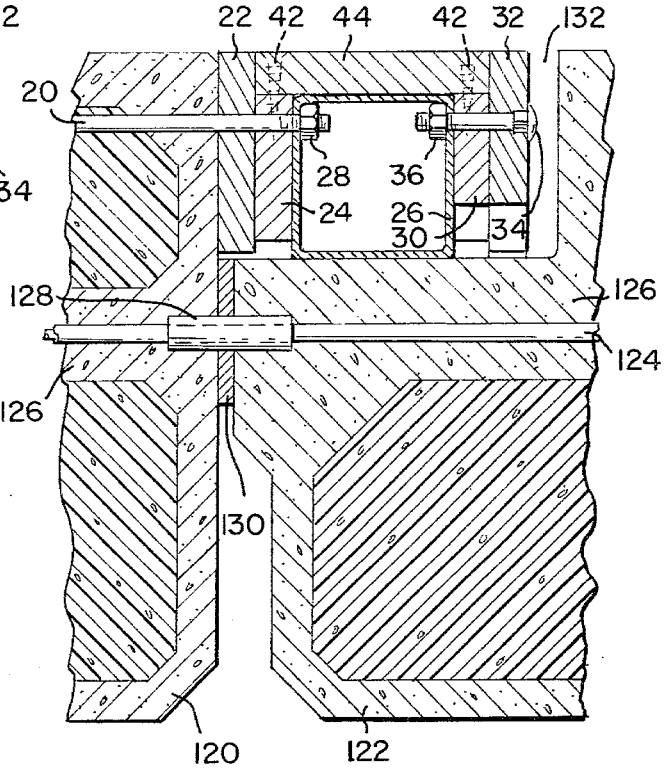
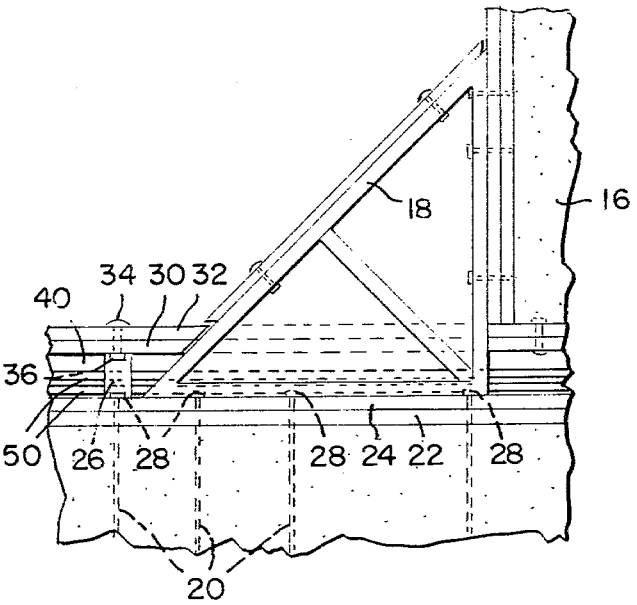
FIG. 14

UTILITY DISTRIBUTION SYSTEM FOR FLOATING PIERS

BACKGROUND OF THE INVENTION

1. Field of the Invention

This invention relates to floating piers, and more particularly to a system for distributing utilities to a plurality of spaced apart points along the piers.

2. Description of the Prior Art

Floating piers formed by a plurality of concrete shells filled with a buoyant material are in common use. The floats are typically arranged to form an elongated mainwalk having a large number of spaced apart finger floats projecting from the mainwalk. Boats are then typically moored on opposite sides of each finger float.

A plurality of tie rods generally extend transversely through the floats with the ends of the tie rods projecting transversely from the sides. The individual floats are then secured to each other by utilizing elongated wales extending along the sides of the floats and fastening the wales by means of the tie rods.

Boats in their moorages normally utilize utilities with a shore-side origin, such as water, electricity, sewer and telephone. Consequently it is necessary to distribute these utilities to spaced apart points along the mainwalk. Utility distribution is typically accomplished by forming a central utility trench along the length of each float and running utility conduits through the trench. The trench is then removably covered with an elongated cover. Conduits are generally embedded in the float during manufacture to allow the utility conduits to extend from the utility trench to the sides of the float where they terminate in conventional utility distribution fixtures which are mounted on the wales.

Although the above described structure effectively distributes utilities to the finger floats, it nevertheless exhibits a number of disadvantages. Formation of the utility trough and embedding the conduits in the float require somewhat more complex forming and finishing than would otherwise be required, thereby increasing the material and labor costs of such floats. Furthermore, the utility trenches preclude the tie rods from extending across the entire width of the float where they would maintain the top, or structural, element of the float in a mild state of compression. Instead, individual tie rods extend from the utility trough to the sides of the floats. Consequently there are no reinforcing members at the centers of the floats so that tensional cracks sometimes develop along the length of the floats.

Utility trough floats are also fairly difficult and hence expensive to install due primarily to the necessity of routing the utility conduits from the utility trough to the sides of the floats. As mentioned above, conduits must be embedded in the concrete forming the float between the utility trench and the side of the mainwalk floats adjacent each finger float. Since the locations of the utility conduits are thus determined during manufacture, a large number of special float types must be manufactured and stocked for specific installations. Since the utility conduits must be routed through these conduits during on-site installation of the floats where working conditions are most difficult and labor rates are higher, the above described utility trough floats are not only more expensive to manufacture, but they are also more expensive to install.

Another problem with utility trough distribution systems arises from the difficulty in bending the utility conduits away from the utility trough with a sufficiently large radius of curvature. Many construction codes specify a minimum radius of curvature for utility conduit bends as a multiple of the conduit's diameter. It is often difficult to route conduits in a utility trough in a manner permitting a sufficiently large bending radius, particularly where the trough is crowded. Consequently, relatively expensive accessories must be used.

Still another problem with concrete floats having a utility trough results from improper drainage of the trough causing eventual corrosion of the utility conduits and electric wires.

A somewhat less troublesome problem associated with utility trough floats results from upwardly projecting portions of the utility trough cover or the fastening bolts for the cover which may be tripped on and thus pose a safety hazard.

Finally, the utility trough concept of utility distribution does not allow existing floating piers which do not have a utility distribution system to be retrofitted with a utility distribution system. Such existing installations can only be retrofitted by replacing the floats themselves. Even existing utility trough systems are sometimes in need of retrofitting when the number of utility services increase and the capacity of the utility troughs are limited by the cross-sectional area of such troughs.

Another technique for distributing utilities throughout a concrete float pier involves securing utility conduits to the underside of wales used to secure the floats to each other. However, this technique leaves the utility conduits unprotected and it requires that holes be bored in either the wales or the floats to route the conduits from beneath the wales to utility distribution fixtures mounted above the wales. These holes must be bored during on-site installation and thus markedly increase the installation costs of such float structures, while possibly weakening structural elements of the floats or wales.

SUMMARY OF THE INVENTION

It is an object of the invention to provide a utility distribution system for floating piers which does not degrade the strength of the floats forming the pier.

It is another object of the invention to provide a utility distribution system which inherently precludes the utility conduits from being intermittently immersed in water.

It is another object of the invention to provide a utility distribution system for floating piers which is relatively inexpensive to manufacture and install.

It is another object of the invention to provide a utility distribution system for concrete float piers which allows installation of utility conduits in a manner which universally complies with construction codes.

It is still another object of the invention to provide a utility distribution system utilizing a standardized float which can accommodate a wide variety of utility outlet fixtures in a variety of locations.

It is a further object of the invention to provide a utility distribution system for floating piers which can be easily retrofitted on existing float structures.

It is still a further object of the invention to provide a floating pier having a utility distribution system in which the quantity of concrete required to form the pier is substantially less than the quantity of concrete needed for comparatively sized piers.

These and other objects of the invention are accomplished by a utility distribution system for a floating pier of the type formed by a plurality of floats having tie rod ends projecting from opposite sides thereof. The system includes a pair of inner wale members extending along opposite sides of the floats with the wale members bridging the joints between adjacent floats and the tie rod ends project through the wale members. A plurality of spacers, preferably having a generally rectangular cross-section, are then secured to the rod ends. Finally, a pair of outer wale members are secured to the outside surfaces of the spacers so that the spacers are positioned between the inner and outer wale members, thereby forming a gap between the wale members. Main utility conduits run through this gap and are supported by the spacers. Alternatively, the spacers form continuous beams and the inner wale members are eliminated. A plurality of spaced apart branch utility conduits are connected to the main utility conduits on each side of the floats and extend to conventional utility outlet fixtures which are mounted on the inner and outer wale members. The spacer members are preferably recessed below the upper edge of the wale members and covered with a flush-mounted elongated cover in order to bridge the gap between the inner and outer wale members. The pier is preferably formed by an elongated mainwalk having a plurality of spaced apart finger floats extending angularly therefrom. The finger floats may be secured to the mainwalk by triangularly shaped frames on which a utility outlet fixture may be mounted. The triangularly shaped frames may be secured to the mainwalk and finger floats through the spacers. Alternatively, the finger floats may be secured to the mainwalk by postensioned tendons extending transversely through the mainwalk and anchored at the far ends of the finger floats. Communication from the main utility conduit to the utility outlet fixtures is provided by the branch utility conduits which extend through the outer wale members beneath the triangularly shaped frame. Alternatively, the utility outlet fixture may be mounted on the wale members with the branch utility conduit extending directly upwardly from the underlying main utility conduit.

BRIEF DESCRIPTION OF THE DRAWINGS

FIG. 1 is a top plan view of a floating pier of the type employing a plurality of finger floats projecting angularly from an elongated mainwalk formed by a plurality of individual floats.

FIG. 2 is a top plan view of the structure for connecting the finger floats to the mainwalk of the pier of FIG. 1.

FIG. 3 is a cross-sectional view taken along the line 3—3 of FIG. 1 illustrating the manner in which the spacers are mounted between inner and outer wale members.

FIG. 12 is a cross-sectional view of an alternative embodiment for recessing the spacers and wales.

FIG. 13 is a cross-sectional view of the utility distribution system showing an alternative technique for securing the finger floats to the mainwalk floats.

FIG. 14 is a top plan view of an alternative embodiment for securing the triangularly shaped braces to the mainwalk floats and the finger floats.

DETAILED DESCRIPTION OF THE INVENTION

Figure 4:
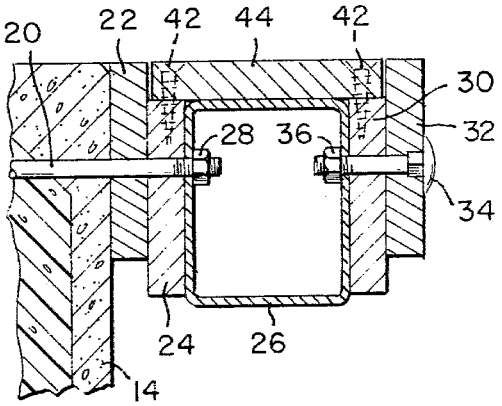
FIG. 4 is a cross-sectional view taken along the line 4—4 of FIG. 1 illustrating the positioning of a main utility conduit between inner and outer wale members.

The floating pier structure employing the inventive utility distribution system, as illustrated in FIG. 1, includes a mainwalk 12 formed by a plurality of individual floats 14 fastened to each other end-to-end. A plurality of finger floats 16 project perpendicularly from the mainwalk 12 at spaced apart locations thereof. Triangularly shaped braces 18 are positioned in each corner between the finger floats 16 and the mainwalk 12 to prevent angular movement of the finger floats 16 with respect to the mainwalk 12.

As illustrated in FIGS. 1 and 3, a plurality of tie rod ends 20 (FIG. 3) project from opposite sides of each mainwalk float 14 and through a pair of inner wale members 22,24 and the inside face of a spacer 26 which preferably has a rectangular cross-section. The inner wale members 22,24 and the spacers 26 are secured to the main walk floats 14 by nuts 28 threaded onto the ends of the tie rods 20.

A pair of outer wale members 30,32 are secured to the outer faces of the spacer 26 by a carriage bolt 34 extending through the wale members 30,32 and the outer face of the spacer 26. The bolt 34 is fastened in place by a nut 36 threaded onto the end of the bolt 34. The inner wale members 22,24 and the outer wale members 30,32 are staggered with respect to each other so that the ends of the wale members 22,30 are adjacent the mid points of the abutting wale members 24,32, respectively. Consequently, the wale members 22,24,30,32 effectively form two continuous, spaced apart members running along each side of the mainwalk float 14. As well understood by those skilled in the art, a pair of spaced apart members provide markedly greater strength than the same members spaced closer to each other since horizontal bending stresses imposed on the mainwalk floats 14 are transformed into compressional and tensional loads on the wale members 22,24,30,32. Greater spacing between the inner wale members 22,24 and outer wale members 30,32 provides greater leverage and greater resistance against bending stresses imposed on the mainwalk 12. Also, the spacing between the inner wale members 22,24 and outer wale members 30,32 causes the outer wale members 30,32 to effectively absorb shocks imparted to the wale members 30,32 by boats.

The spacers 26 and the adjacent wale members 24,30 are recessed below the wale members 22,30 and the upper surface of the mainwalk float 14. This recessing provides sufficient clearance for an elongated cover 40 (FIG. 3) which extends along the mainwalk 12 to bridge the gap between the wale members 24,30 intermediate the spacers 26. The cover 40 is secured in place by conventional screws 42. An alternative embodiment illustrated in FIG. 5 utilizes a wood panel 44 which is substantially thicker than the metal plate 40 of the embodiment of FIG. 3. Consequently, the wale members 24,30 and the spacer 26 are recessed to a greater degree to provide the additional clearance required by the thicker panel 44.

The width of the wale members 22,24,30,32 and the cover 40 or panel 44 advantageously increases the overall width of the float so that the total quantity of concrete required to form the float is markedly less than the quantity of concrete otherwise required to form a float having that same width.

Figure 8:
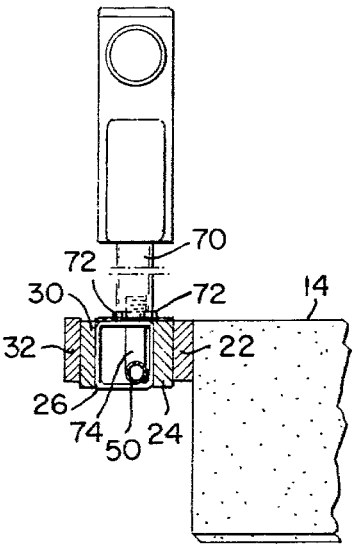
FIG. 8 is a cross-sectional view taken along the line 8—8 of FIG. 1 illustrating a conventional utility outlet fixture mounted on the wale members above a spacer.

As best illustrated in FIGS. 2 and 8, a plurality of utility conduits 50 extend along the mainwalk 12 between the wale members 24,30 beneath the panel 40. The conduits 50 are supported by the spacers 26 and, as explained hereinafter, are connected to conventional utility fixtures by branch utility conduits (shown hereinafter).

Figure 11:
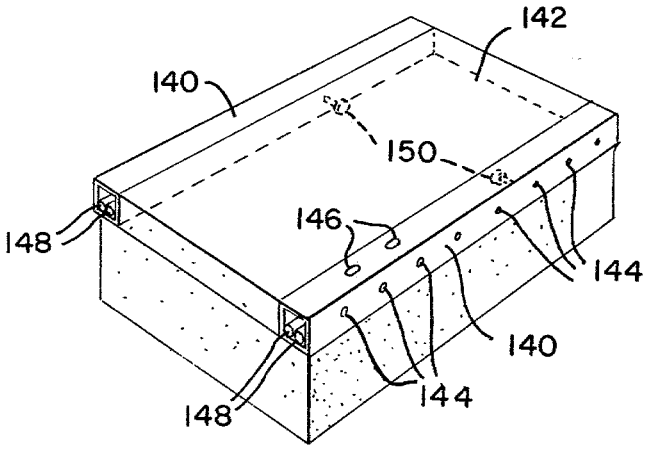
FIG. 11 is an isometric view of an alternative embodiment of the utility distribution system in which the utility access tubes are recessed in the upper side edges of the floats.

An alternative embodiment in which the utility distribution system is recessed in the upper edge of the mainwalk 15 is illustrated in FIG. 12. The distribution system structure of FIG. 12 is substantially identical to the structure illustrated in FIG. 3. Consequently, like elements are identically numbered and are explained with reference to FIG. 3. The embodiment of FIGS. 11 and 12 is particularly advantageous for use where finger floats project from only one side of the mainwalk.

Figure 6:
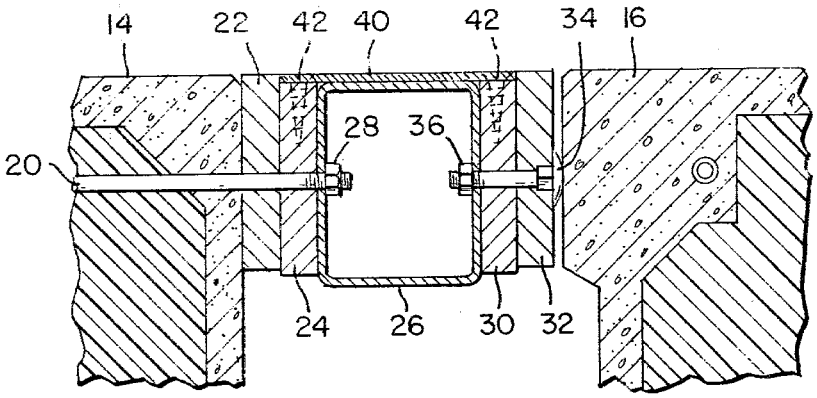
FIG. 6 is a cross-sectional view taken along the line 6—6 of FIG. 1 showing the utility distribution system structure between the end of the finger float and the mainwalk.

As best illustrated in FIG. 6 the structure of the wale members 22,24,30,32 and spacers 26 adjacent the finger float 16 is identical to the structure intermediate the finger floats 16. Thus it is not necessary to provide a special attachment structure for securing the finger floats 16 to the mainwalk floats 14 other than the triangularly shaped braces 18.

Figure 7:
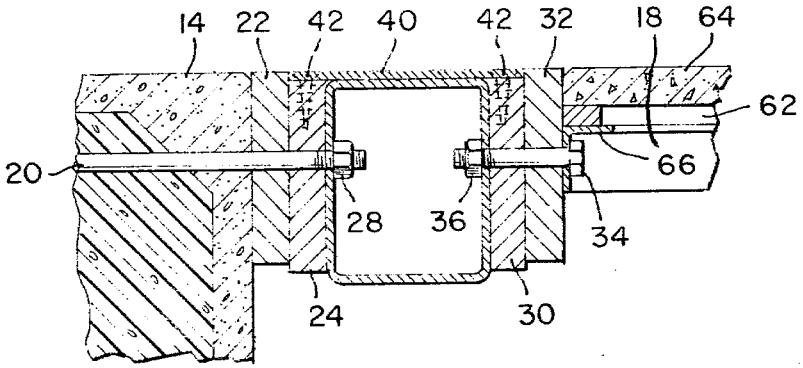
FIG. 7 is a cross-sectional view taken along the line 7—7 of FIG. 1 illustrating the manner in which the triangularly shaped brace is fastened to the spacers and outer wale members.

The manner in which the triangularly shaped braces 18 are secured to the mainwalk floats 14 and finger floats 16 are best illustrated in FIGS. 2 and 7. The braces 18 include a triangularly shaped frame 62 covered by a triangularly shaped filler 64. An angle bracket 66 is secured to the underside of the frame 62 in a suitable manner and it extends downwardly along the outer surface of the outer wale member 32. The bolt 34 fastening the outer wale members 30,32 to the spacer 26 extends through the bracket 66 thereby securing the triangularly shaped brace to the mainwalk 12. A similar structure is utilized to secure the finger floats 16 to the brace 18.

An alternative structure for securing the triangularly shaped braces 18 to the mainwalk floats 14 and finger floats 16 is illustrated in FIG. 14. In this embodiment the upper surfaces of the outer wale members 30,32 are recessed to provide clearance so that the bracket 66 (FIG. 7) can be secured to the tie rods 20 by respective nuts 28 adjacent the inner wale member 24 instead of adjacent the outer wale member 32 as with the embodiment of FIG. 7. The utility conduits 50 thus extend beneath the brace 18 and can therefore easily be routed to a utility distribution fixture mounted on the brace 18.

An alternative technique for securing finger floats to the mainwalk is illustrated in FIG. 13. Basically, this embodiment differs from the previously described embodiments by utilizing a postensioned tendon extending transversely through the mainwalk float 120 and terminating at the ends of the finger floats 122 to secure the finger floats 122 to the mainwalk float 120. More specifically, the postensioned tendon 124 extends transversely through a horizontal bulkhead 126, passes through a cylindrical shear pipe 128 bridging the gap between the mainwalk float 120 and the finger float 122 and is anchored to the end of the finger float 122 by conventional means. The shear pipe 128, which is received by cylindrical bores formed in the sides of the floats 120, 122, restricts relative movement between the floats 120,122 in a direction parallel to the side of the mainwalk float 120 which might otherwise eventually sever the postensioned tendon 124. The tendon 124 and shear pipe 128 project through a resilient sheet 130 in order to allow the finger floats 122 to pivot with respect to the mainwalk floats 120 responsive to wave action and to prevent direct contact between the floats 120, 122 which might chip the concrete forming the floats 120, 122. The upper inside edge of the finger float 122 is recessed at 132 to provide clearance for the wale members 22,24,30,32 and spacer 26. Also, the lower portions of the outer wale members 30,32 are notched to provide clearance between the wale members 30,32 when the finger float 122 pivots upwardly responsive to wave action.

As illustrated in FIG. 8, a conventional utility outlet fixture 70 is mounted above one of the spacers 26 between the wale members 24,30 and secured thereto by threaded fasteners 72. A branch utility conduit 74 connected to the main utility conduit 50 extends upwardly between the upper surface of the spacers 26 into the fixture 70. The fixture 70 includes appropriate connectors for supplying electricity, telephone service and water to vessels moored adjacent the finger floats 16.

Figure 5:
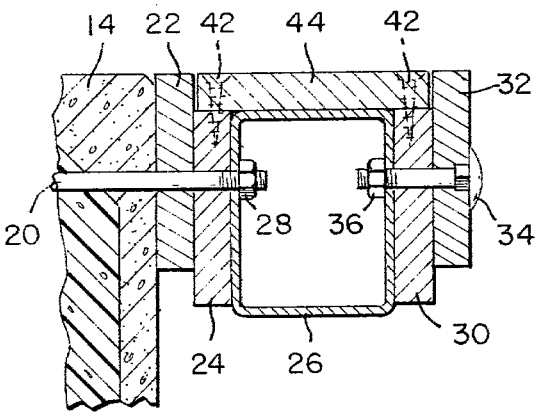
FIG. 5 is a cross-sectional view taken along the line 5—5 of FIG. 1 illustrating an alternative embodiment to the embodiment of FIG. 3.
Figure 9:
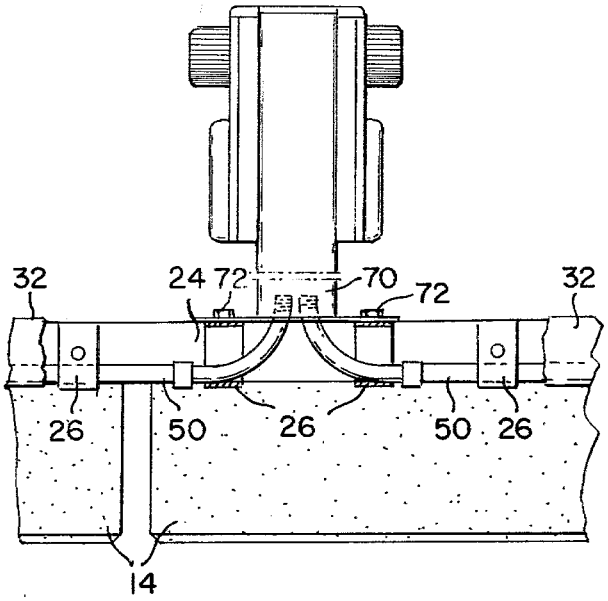
FIG. 9 is a cross-sectional view taken along the line 9—9 of FIG. 1 illustrating the manner in which a conventional utility outlet fixture is mounted on the wale members intermediate a pair of spacers.

Another view for connecting a conventional utility fixture to the main utility conduit is illustrated in FIG. 9. In this embodiment the utility outlet fixture 70 is secured to the wale members 22,24,30,32 by bolts 72 intermediate the spacers 26, and the main utility conduits 50 pass through the utility outlet fixture 70 where it is internally tapped. Access to the main utility conduits 50 between the wale members 24,30 is provided by simply removing a portion of the cover plate 40 (FIG. 3) or elongated panel 44 (FIG. 5). Thus installation can be quickly and easily accomplished after the floats are secured in position.

The inventive utility distribution system inherently allows the utility conduit to have a relatively large bending radius as is readily apparent from FIG. 9. The bending radius of the conduit 50 can be increased to virtually any degree merely by increasing the length of the cutout formed in the cover plate and increasing the width of the stand for the fixture 70 along the length of the wale member 32. Consequently, the inventive structure universally complies with construction codes.

It will be noted that the combined width of the wale members 22,24,30,32 and spacer 26 is substantially wider than the wales which are used to join conventional floats. Thus the mainwalk floats 14 of the present invention can be proportionately narrower than conventional floats and still provide the same overall width.

Consequently, piers formed by the floats 14 of the present invention utilize less concrete than those having the same width using conventional floats. Also, the lack of a utility trench reduces the quantity of concrete required. Since the piers formed according to the present invention utilize less concrete the manufacturing costs are lower.

Figure 10:
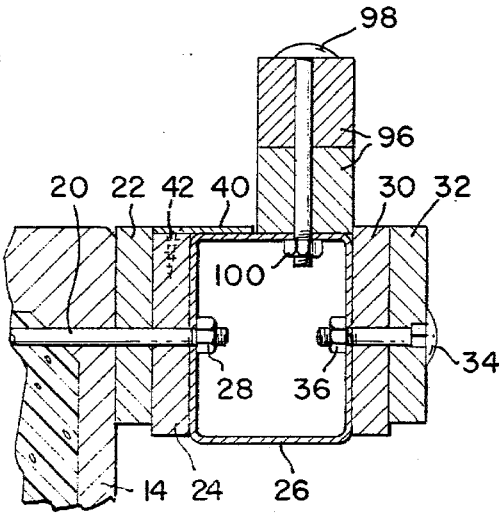
FIG. 10 is a cross-sectional view taken along the line 10—10 of FIG. 1 showing the manner in which a bull or tie down rail is mounted on the utility distribution system.

The inventive utility distribution system also readily lends itself to the installation of marine fixtures unrelated to utility distribution. As illustrated in FIG. 10, a bull or tie rail 96 may be installed above the wale members by a bolt 98 extending vertically therethrough and through a bore formed in the upper surface of the spacer 26. The bolt 98 is then fastened to the spacer 26 by a nut 100.

An alternative embodiment utilizing a hollow beam 140 having a rectangular cross-section as a spacer is illustrated in FIG. 11. The upper side edges of the float 142 are recessed to receive the beam 140, with the beam 140 being secured into the poured concrete by the utilization of concrete anchors 150. A plurality of apertures 144 formed in the sides of the beam 140 receive the ends of the tie rods projecting from the float 142. The tie rods ends also project through wale members which bridge the joints between adjacent floats to secure the floats to each other. A plurality of apertures 146 formed in the upper surface of the beam 140 allows utility conduits 148 extending through the beam 140 to pass upwardly through the upper surface of the beam 140 to a conventional utility distribution fixture (not shown) secured to the upper surface of the beam 140.

The inventive utility distribution system is thus relatively inexpensive to manufacture and install. Furthermore, instead of weakening the basic structure of the main walk, it instead further strengthens the connecting structure between adjacent mainwalk floats. It may also be retrofitted on existing float structures without extensive modifications and it is capable of being connected to a variety of conventional utility fixtures.

I claim:

1. A utility distribution system for a floating pier formed by a plurality of floats having tie rod ends projecting from opposite sides of said floats, comprising:

a pair of inner wale members extending along opposite sides of said floats with said wale members bridging the joints between adjacent floats, said wale members being secured to said tie rod ends;

a plurality of spacers secured to said tie rod ends along the outer face of said inner wale members;

a pair of outer wale members extending along opposite sides of said floats with said spacers positioned between said inner and outer wale members, said outer wale members being secured to said spacers;

a main utility conduit extending along each side of said floats between respective inner and outer wale members, said utility conduits being supported by said spacers; and conduit means for connecting said main utility conduits on each side of said floats to utility service positions above said wale members.

2. The utility distribution system of claim 1 wherein the upper surfaces of said spacers are recessed below the upper surface of said floats and at least a portion of said wale members, and wherein an elongated cover extends between adjacent spacers intermediate said inner and outer wale members thereby bridging the gap between said inner and outer wale members intermediate said spacers.

3. The utility distribution system of claim 1 wherein said floats form an elongated mainwalk having a plurality of finger floats extending angularly therefrom at spaced apart points, said system further including a triangularly shaped brace extending between said mainwalk and each finger float at opposite corners thereof, said brace being secured to said mainwalk by an elongated fastening member extending from said brace and one of said wale members.

4. The utility distribution system of claim 3 wherein the edge of said triangularly shaped brace adjacent said mainwalk abuts the outer surface of the outermost outer wale member and said fastening member extends through said outer wale members and said spacer.

5. The utility distribution system of claim 3 wherein the edge of said triangularly shaped brace adjacent said mainwalk abuts the outer surface of the outermost inner wale member with said outer wale members terminating adjacent the hypotenuse of said triangularly shaped brace, and said fastening member is a tie rod end extending through said inner wale members and said triangularly shaped brace.

6. The utility distribution system of claim 1 further including a utility outlet fixture mounted on the upper surface of said wale members with a branch utility conduit extending upwardly from said main utility conduit beneath said utility outlet fixture and terminating within said utility outlet fixture.

7. The utility distribution system of claim 1 wherein said inner and outer wale members are each formed by a pair of elongated structures longitudinally staggered with respect to each other such that the ends of one structure are adjacent the mid-point of the other structure.

8. The utility distribution system of claim 1 wherein said spacers have a generally rectangular cross sectional shape.

9. The utility distribution system of claim 1 further including a rail mounted on said wale members by a bolt extending downwardly through the upper surfaces of said spacers.

10. The utility distribution system of claim 1 wherein a recess having a generally rectangular cross section is formed along the upper side edge of each float and receives said wale members and said spacers such that said utility distribution system is at least partially recessed into the sides of said floats.

11. The utility distribution system of claim 1 wherein said floats form an elongated mainwalk having a plurality of finger floats extending angularly therefrom in opposed pairs at spaced apart points, said system further including means for securing said finger floats to said mainwalk including a horizontal bulkhead formed in said mainwalk intermediate the upper and lower surfaces thereof, and a postensioned tendon extending transversely through said bulkhead beneath said wale members to the ends of said finger floats where the ends of said tendon are anchored.

12. The utility distribution system of claim 11 wherein a pair of spaced apart tendons extend through said bulkhead and along opposite sides of said finger floats.

13. The utility distribution system of claim 11 further including a shear pipe through which said tendons passes extending between the sidewall of said mainwalk and the end wall of each finger float and a sheet of resilient material positioned between said mainwalk and said finger float through which said shear pipe passes.

14. The utility distribution system of claim 1 wherein said spacer is a continuous elongated beam having a rectangular cross section, said beam including a plurality of apertures formed in its outer sidewall adapted to receive said tie rod ends and a plurality of apertures formed in its upper surface through which said utility conduit is adapted to pass.

* * * * *